United States Patent [19]

Micallef

[11] 4,006,836

[45] Feb. 8, 1977

[54] SAFETY CAP

[75] Inventor: Lewis A. Micallef, Fort Lee, N.J.

[73] Assignee: Leeds and Micallef, Fort Lee, N.J.

[22] Filed: Jan. 8, 1976

[21] Appl. No.: 647,328

[52] U.S. Cl. ..... 215/218

[51] Int. Cl.[2] ..... B65D 55/02; B65D 85/56; A61J 1/00

[58] Field of Search ..... 215/217, 218, 330, 334, 215/274

[56] References Cited

UNITED STATES PATENTS

| | | | |
|---|---|---|---|
| 2,574,239 | 11/1951 | Bell | 215/217 |
| 3,656,646 | 4/1972 | Taylor | 215/218 X |
| 3,857,507 | 12/1974 | Lecinski, Jr. | 215/218 |
| 3,895,731 | 7/1975 | Coursant | 215/218 |

*Primary Examiner*—George T. Hall
*Attorney, Agent, or Firm*—Kane, Dalsimer, Kane, Sullivan and Kurucz

[57] ABSTRACT

A safety cap for a container including an outer cover having an end wall and a peripheral skirt depending therefrom with a band mounted in the cover. The band and cover are designed for rotatably fastening and unfastening the cap on a container. The band and cover include lock structure to permit rotation of the band and cover onto the container into the fastened position and to prevent rotation of the band and cover into the unfastened position with respect to the container. Furthermore, release structure is provided on the band and cover and is adapted to be shifted between an inactive position whereupon it does not effect the operation of the locking structure and an active position whereupon it deactivates the locking structure and permits the band and cover to rotate into the unfastened position.

23 Claims, 16 Drawing Figures

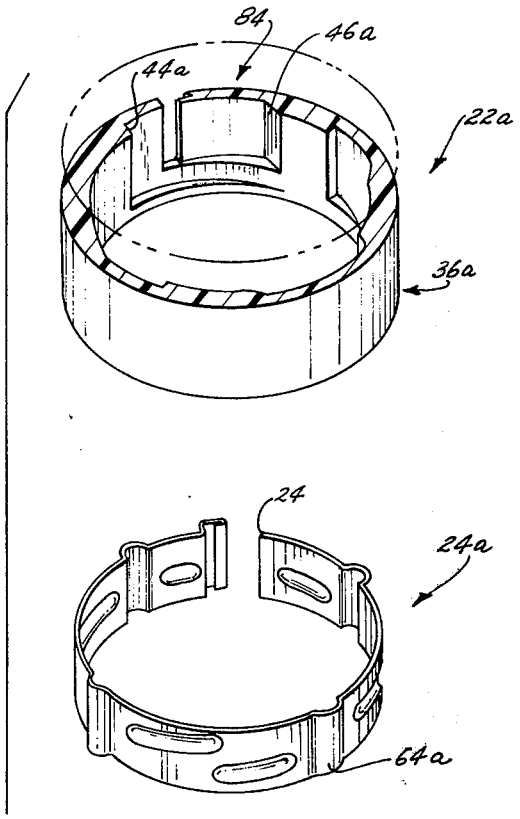
FIG. 9
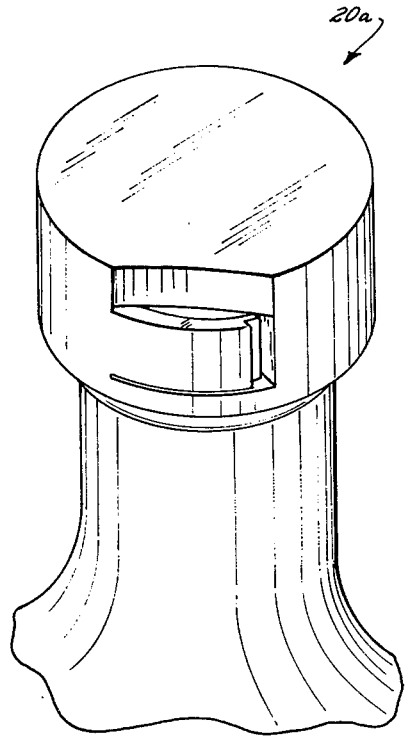
FIG. 10
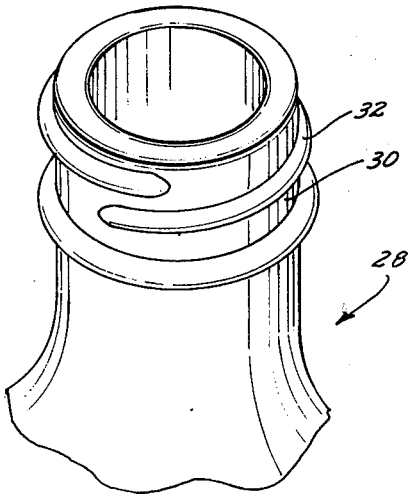

SAFETY CAP

BACKGROUND OF THE INVENTION

Safety caps or closures are in frequent use today particularly when harmful substances including medicaments are utilized in the home and are exposed to the public in glass or plastic containers. The danger of access to the containers by small children is of great concern and accordingly, it has been determined that a safety cap forms an effective deterrent against the danger of children gaining access to the contents of the containers. Naturally, the cap must be one that an adult can easily maneuver and utilize to permit ease of access for use. In many instances where small children are not present in the house, the presence of a safety cap can become a nuisance to adults or other persons who are not endangered by the contents of the container but who have to frequently open and close the container to gain access to the contents. With mass production and cost being of significance today, it is undesirable to have containers which are manufactured with different types of caps for different consumer uses. For example, it would be more expensive to manufacture a specific size and type container with two different types of caps. It is apparent that the manufacturing cost as well as handling and distribution cost would be increased. Therefore, it is of advantage if a cap could be provided which is convertible between a use as a safety cap and a use as a standard type cap which can be normally fastened and unfastened on the container. Also, the cap should be designed so that it can immediately automatically shift to the safety condition when it is placed on the container and directed toward the fastened position. While keeping in mind that such a convertible type of cap is desirable, it should also be kept in mind that the more complex the design of the cap, the greater the cost in manufacture, assembly and use. Consequently, the cap should be of a minimum number of parts and should be easy and efficient to use with the user being quickly able to shift between the safety cap use and the standard type of cap use.

SUMMARY OF THE INVENTION

With the above background in mind, it is a primary objective of the present invention to provide a convertible safety cap which is of a minimum number of components, is inexpensive to manufacture and assemble for use and which can be quickly and efficiently converted between a safety cap use with lock means to prevent a child getting access to the contents of the container and a use where the cap acts as a conventional type of cap which can be shifted between the fastened and unfastened positions in a standard manner. It should also be noted that the cap is structured so that it can be easily shifted between the two positions and also when it is in use as a safety cap, it is easy for an adult or other person entitled to access to the container to unlock the safety cap and gain access and then to return the cap to the container whereupon it will once again be in the safe and locked condition automatically.

In summary, a safety cap is provided for a container with an outer cover having an end wall and a peripheral skirt depending from the end wall. A band is mounted in the cover and means is in the band and in the cover for rotatably fastening and unfastening the band and cover on a container. Lock means is on the band and cover to permit rotating of the band and cover onto the container into the fastened position and to prevent rotating of the band and cover into the unfastened position. Release means is on the band and cover and is adapted to be shifted between an inoperative position whereupon it does not affect the operation of the lock means and an active position whereupon it activates the lock means and permits the band and cover to rotate into the unfastened position.

In a comtemplated embodiment of this invention, an automatic lock-out feature is incorporated where the cap may be converted to a structure where it acts as a conventional cap without the safety lock feature. In this and another embodiment structure is employed which permits the cap to be manually operated to unlock the cap in a manner which is disguised from the ease of operation by a child and is designed for ease of operation by an adult and the locking structure of both embodiments as well as the entire concept of the present invention includes the feature of a lock means which automatically takes effect when the cap is returned to the container either partially or into the fully fastened condition. It cannot once again be opened without actuation of the release means for the locking structure.

With the above objectives among others in mind, reference is had to the attached drawings.

BRIEF DESCRIPTION OF THE DRAWINGS

FIG. 9 is an exploded view of a further embodiment of a safety cap according to the invention shown in alignment with a fragmentary portion of a container to which the cap is to be applied and with the top of the cover portion of the cap removed;

FIG. 10 is a perspective view of the further embodiment shown coupled with a fragmentary portion of a container;

DESCRIPTION OF THE PREFERRED EMBODIMENTS

Figure 1:
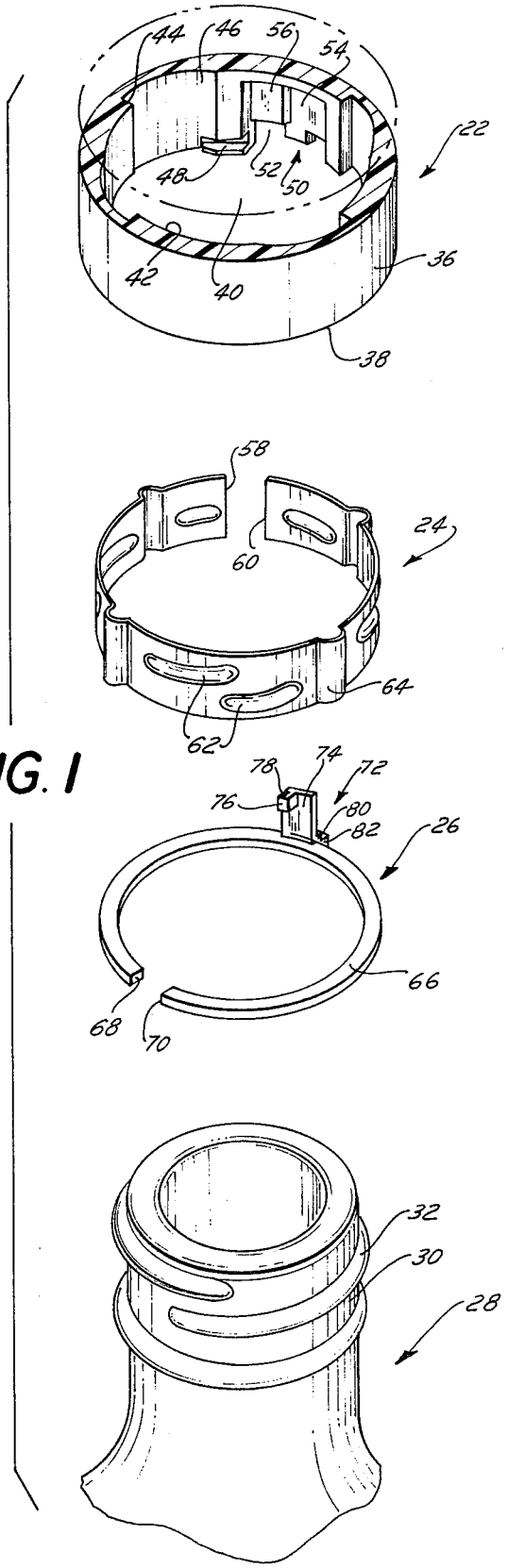
FIG. 1 is an exploded view of the components of the safety cap of the invention with the top of the cover portion removed and showing the components in alignment with the top of a container to be capped.
Figure 2:
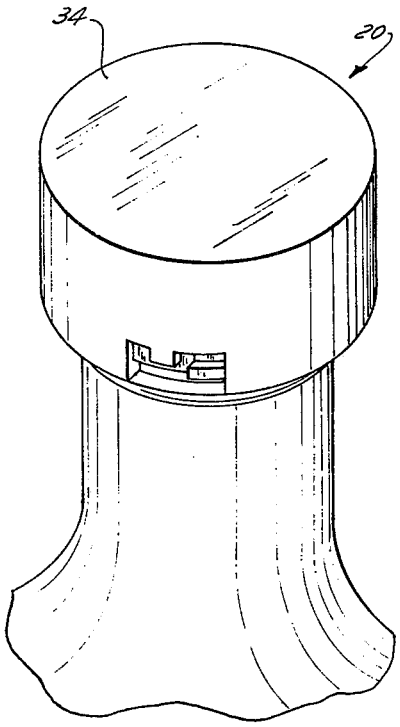
FIG. 2 is a fragmentary perspective view of the safety cap mounted on a container.

Two depicted embodiments of the safety cap of the present invention are shown in the drawings. The first embodiment is represented in FIGS. 1–8 and the second embodiment is represented in FIGS. 9–16.

Safety cap 20 of FIGS. 1–8 includes a cover portion 22, a circular band 24 and a control ring 26. The cap 20 is designed for coupling with a container 28 having a reduced neck portion 30 with threads 32 on the outer surface of the neck portion.

The cover 22 includes an end wall 34 and a depending peripheral skirt 36 terminating in a rim 38 surrounding the central opening 40 in the cover. The inner peripheral surface of skirt 36 includes a number of surface portions which are used for specific purposes in operation of the cap.

Spaced about the periphery of the inner surface are four inwardly extending abutting surfaces or shoulders 44. Facing each shoulder is a corresponding inclined tapered cam surface 46 also tapering inwardly toward the center of the cover. Appropriate undercuts, slots or notches 48 are provided about the bottom peripheral portion of skirt 36 to form a shelf for receipt of control ring 26 to assist in maintaining the control ring and the band 24 in position within the cover.

An operational cutout 50 is provided at a predetermined point about the circumference of the cover which provides the access to the interior of the cover and which has surfaces to cooperate with the release and control mechanism for operating the safety features of the cap 20. Cutout 50 is formed with an open bottom portion 52 substantially rectangular in configuration and partially bisected by a downwardly extending tooth or keeper 54 separating opening 52 into two positions. The opening portion on one side of keeper or tooth 54 forms a slot for positioning of the release mechanism when the cap is in position for use as a safety cap. The portion of opening 52 on the other side of tooth or keeper 54 is in alignment with a lock-out shoulder 56 which is designed for permanent retention of the release mechanism and consequent deactivation of the lock means when the safety cap 20 is to be used as a conventional type cap for a container with no functioning lock mechanism. Manual shifting of the release structure between both positions on opposing sides of keeper 54 automatically converts the cap between its structure as a conventional cap and its structure as a safety cap.

The cover or overcap 22 can be designed of a conventional molded plastic or metal structure and can have the inner surface portions formed on the skirt 36 molded in position thereby forming the cover in a one-piece operation. This would include molded cam surfaces 46, shoulders 44, undercuts 48 and the structure forming access opening 50.

Band 24 is constructed of strong metal or plastic material being somewhat rigid but having some resiliency as well and can be preformed as a one-piece structure with appropriate surfaces thereon. Band 24 is circular in configuration and has an interrupted portion so as to form spaced opposing edges 58 and 60 so that the band can be compressed bringing edges 58 and 60 closer to one another and be permitted to return to its relaxed condition as shown in FIG. 1 with edges 58 and 60 spaced from one another. A number of interrupted threads 62 are formed in the band for interengagement with threads 32 on the top of container 28 to permit rotation of the cap between the fastened and unfastened conditions. Spaced about the periphery of band 24 are four annular projections 64 with each projection positioned for alignment between a shoulder 44 and cam 46 arrangement on the inner surface of the cover 22. The number of projections 64 and corresponding shoulders 44 and 46 are a matter of choice and four has been found to be an acceptable number and is the chosen depicted form. The height of circular band 24 is less than the height of skirt 36 so that it can comfortably be received within the skirt and the outer relaxed diameter of the band is accordingly dimensioned so that it can be received comfortably within the skirt.

The control ring 26 includes a circular base 66 with an interrupted portion to form opposing edges 68 and 70 and to thereby provide resilience to the ring 66 which can also be of a conventional metal or plastic material being somewhat rigid yet having some resiliency. Attached to base 66 of the control ring 26 is a control tab 72 which includes an upstanding wall portion 74 having an inwardly extending projection 76 on its inner upper surface portion. Projection 76 includes a slot 78 in one side thereof for receipt of an edge 58 of band 24 in a manner described below in relation to operation of the safety cap. Tab 74 is mounted to base 66 at its lower and includes double step portion extending outwardly from its lower end. The upper step portion 80 forms one control surface and the lower step portion 82 forms a second control or keeper surface which extends outwardly from base 66.

Band 24 and retainer ring are positioned within cover 22 so that base 66 is received within notches or undercuts 48 with band 24 resting on the upper surface of base 66 and control tab portion 82 extending outwardly from opening 52.

In addition to the inwardly projecting surface which forms undercut or notches 48 supporting the control ring and accordingly holding the band in place, it also transmits holding pressure to the underside of the cap when it is screwed down onto the container or bottle 28. The fact that the ring 26 is split or interrupted in its circular path, provides the effect that by pressing inwardly on tab structure 72, a springing action is achieved which returns the projection 82 and the remaining tab structure 72 to its original position upon release. The tab structure 72 is designed for two-position use with respect to opening 50. These positions can be identified as a temporary lock-out position and a permanent lockout position depending upon the location of the tab with respect to the portions of the aperture 52 spaced by tooth 54. Tab 72 may be moved readily between the two positions at the option of the user.

It has been found effective to form band 24 of a metal stamping which has pressed into it the threads 62 which mate with the threads 32 of bottle or container 28. As stated above, the longitudinal ribs or projections 64 on the outer surface of band 24 correspond in position and number to the cam surfaces 46 on the inner surface of skirt 36. These ribs or projections 64 may also be pressed into the metal and for this reason in the depicted embodiment, the threads 62 are shown interrupted. This in no way interferes with their efficient operation. To increase the traction surface on the inner surface of the band, it is possible to coat the inner surface with a rubber-like material such as neoprene. The material could be precoated on the steel before the band is formed. By providing a coating for the band one can combine the strength and flexibility of steel and a wide choice of coating, plus speed of manufacture with the coating being applied before the band is formed. As stated above, it is possible to form the band of plastic or other materials which by their nature would require no traction coating such as asbestos filled fiber which has a rough surface.

Since band 24 is split or interrupted in its circular configuration, it is free to expand and contract forward and away from its center. And, because of the traction coating, there is always present a slight amount of drag between the band and the neck 30 of the container or bottle 28 when the cap 20 is screwed and unscrewed. It should also be noted that the cap need not be screwed down completely onto the container to be effective. Partial threaded interengagement will still permit the locking function to be actuated should an attempt be made to reverse the direction of the cap and remove it once again from the container.

No special consideration may be given to placing the cap onto the bottle in a normal filling line, since the cap behaves in a conventional manner when rotated in a clockwise direction. Band 24 is free to rotate within the limits determined by the spaced cam surfaces 46 and shoulders 44. In the clockwise direction, the ribs or projections 64 on band 24 move until they abut the corresponding shoulders 44 opposite the cam surfaces and no contraction of the band takes place. The relative movement between the band and the cap is caused by the slight frictional drag mentioned above. This condition is depicted in FIG. 3 of the drawing with the arrow showing the direction of rotation of the cap with respect to the container.

Figure 3:
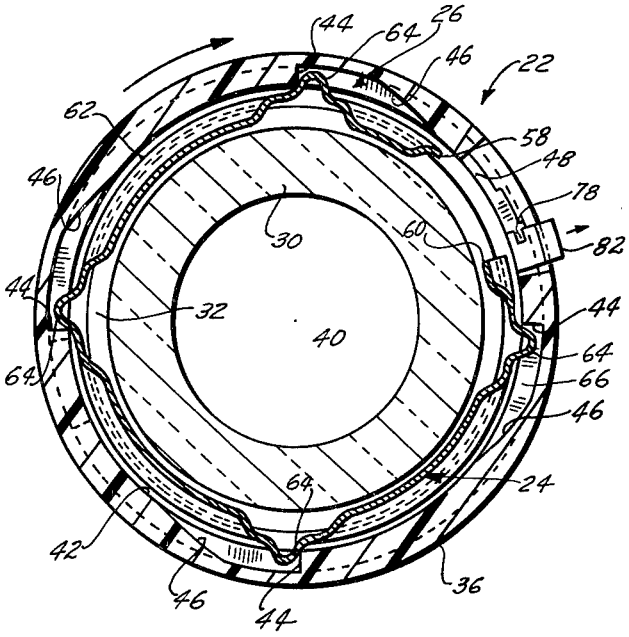
FIG. 3 is a sectional top view thereof showing the cap when it is being freely rotated to the fastened position on the container.
Figure 4:
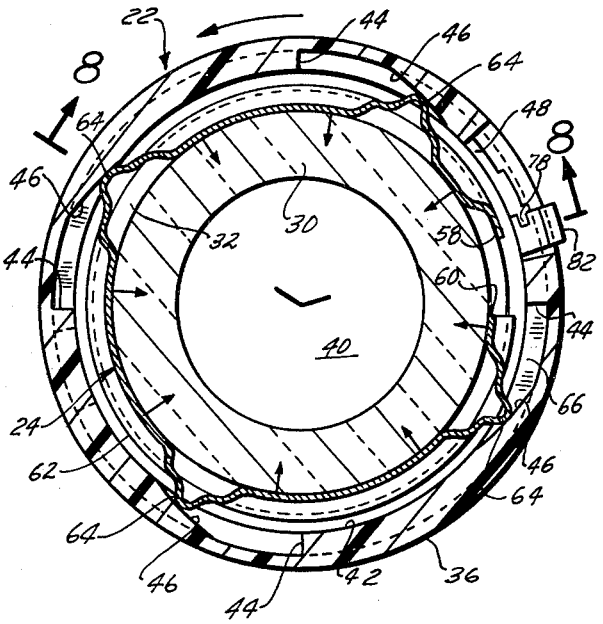
FIG. 4 is a top sectional view thereof showing the locking structure within the cap in effect when an attempt is made to unfasten the cap from the bottle without releasing the locking structure.

Rotating the cap in a counterclockwise direction, as depicted in FIG. 4, will cause band 24 to rotate until the projections 64 contact the cam surfaces 46. Further movement in this direction forces band 24 to contract around the neck 30 of the container 28 until the traction surface takes full effect and further rotation of both cover 22 and band 24 is impossible. During the above action it is understood that the control tab 72 is in the safety position. This is true for both the action depicted in FIG. 3 and in FIG. 4 where portion 82 of tab 72 extends through opening 52 on the side of tooth 54 distal from locking shoulder 56.

Figure 5:
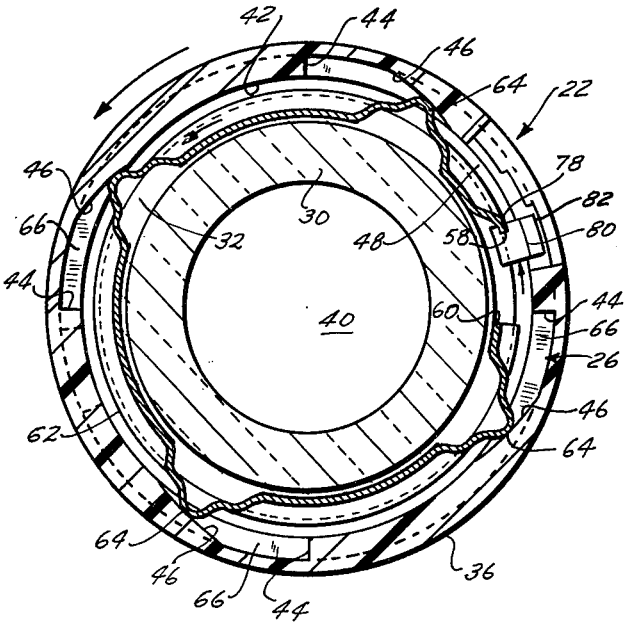
FIG. 5 is a sectional top view thereof showing the releasing structure having been manually positioned to release the locking structure so that the cap can be rotated to the unfastened position.

In order to remove the cap 20, the user presses inward on tab 72 while rotating cap 20. After about 45°, the leading edge 58 of band 24 will be in contact with tab 72 and its further rotation will be stopped. This interengagement is facilitated by alignment of notch 78 with leading edge 58 so as to receive the leading edge therein. The notch also has the affect of interengaging the tab with the band so that the tab is retained in its depressed condition. Thereafter, the design of the notch and the remaining tab structure is such that continuous rotation in a counterclockwise direction will hold the tab 72 in. In this manner, the locking means as provided by the band and as depicted in FIG. 4 is released and overcome as shown in FIG. 5. Continued rotation in the counterclockwise direction will permit the cap to be fully unfastened and removed from the container.

The slightest movement in a clockwise direction will disengage notch 78 from edge 58 of the band and will permit the tab to spring outward freeing the band from the cap and returning the cap to its safety configuration with portion 82 projecting through opening 52 again as shown in FIGS. 3 and 4. If the notch on the tab is still in engagement with the edge of the band when the cap is off the bottle, screwing the cap back on will automatically disengage it and the cap is once more in a safety operating condition for immediate effectiveness upon initiation of threading of the cap onto the container as depicted in FIG. 3.

Figure 6:
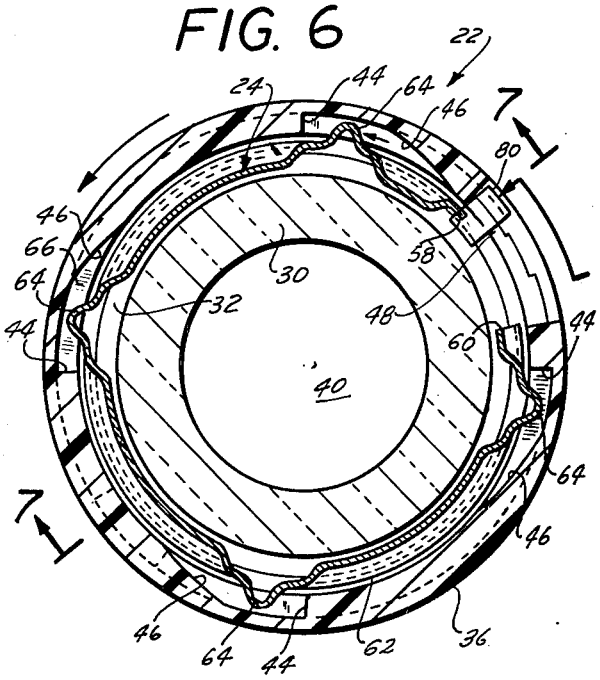
FIG. 6 is a top sectional view thereof showing the release means having been shifted to a permanent lock-out position whereupon the cap acts as a conventional cap and can be rotated freely between the fastened and unfastened condition without actuating the locking structure.
Figure 7:
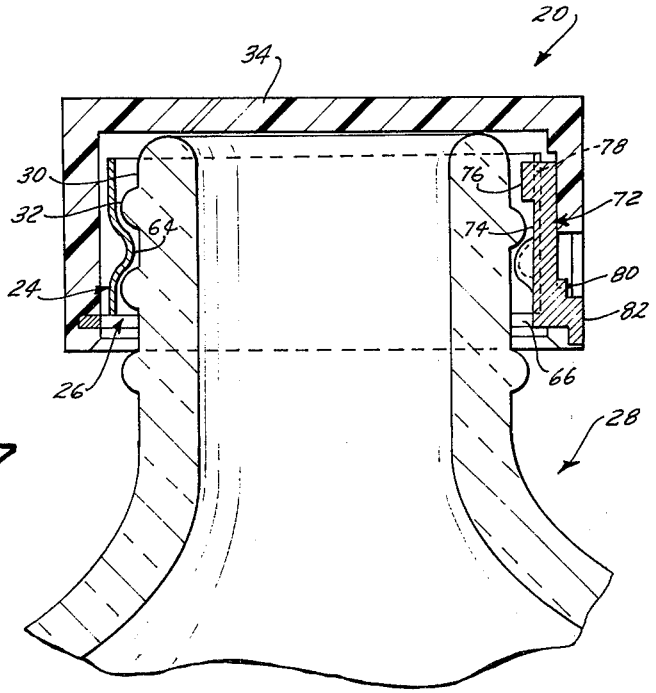
FIG. 7 is a fragmentary side elevation view thereof taken along the plane of line 7—7 of FIG. 6.
Figure 8:
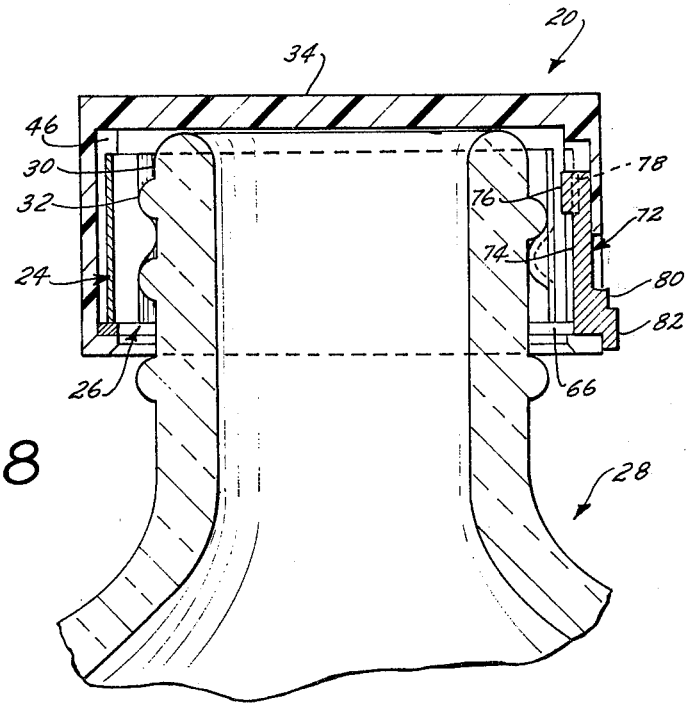
FIG. 8 is a fragmentary side elevation view thereof taken along the plane of line 8—8 of FIG. 4.

When it is desired to permanently release the locking function of the locking means as provided by the band, cap 20 is provided with an overriding feature which causes it to work as a conventional ordinary cap for the bottle or container. In order to utilize this feature, the use removes the cap from the container, presses tab 72 inward and moves it to the second position within aperture 52 on the other side of tooth 54 and in alignment with keeper surface or shoulder 56. The second position with the tab in engagement with the keeper surface 56 holds the tab 72 depressed so that the band 24 is stopped from rotating before projections 64 reach cam surfaces 46. This condition is depicted in FIG. 6 of the drawings. In this condition, the release means in the form of the tab is fixed in release position to prevent the lock means as performed by the band from acting whether the cap is rotated in either the clockwise or the counterclockwise direction. Therefore, the cap will act as an ordinary cap in respect to its engagement and disengagement with the container. Should the user wish to return the cap to a safety configuration he merely moves the tab back to the first position on the other side of tooth 54 where it can be operated as described above and in connection with FIGS. 3–5. Tooth 54 prevents the tab from being accidentally moved from one position to the other when the cap is positioned on the container. No rotational movement of the tab can take place since there is not enough clearance to move the tab beyond the tooth or keeper 54 which divides the two positions.

An alternative depicted form of the invention appears in FIGS. 9–16 and is similar in some respects as the initially discussed embodiment and similar parts are identified with the same numerals with the addition of the subscript *a* added thereto. There are changes in structure particularly in regard to the release means for operating the lock structure provided by the band **24*a*. Skirt 36*a* of cover 22*a* has a different arrangement at the location of the portion of the skirt where the release means is activated The structure of cap 20*a* is designed so that there is no lock-out feature so that the cap can operate as a conventional cap for a container without the safety mechanism. The safety operation is essentially the same as in the previously discussed embodiment, however, a control ring is not employed. Instead, a portion of the skirt 36***a* for example a portion of cam surface 46*a* is detached from the remaining portion of the skirt so as to form a cantilever tab section 84 as part of the wall. The cantilever tab can be pressed due to the natural resiliency of the material of the cover inward to lock the band to the cap and prevent activation of the locking means when the cap 20 is rotated counterclockwise. Similar to the previous embodiment upon release of tab 84 it will return to its relaxed configuration, due to the natural resiliency of the material of the cover, substantially contiguous with the remaining skirt structure 36*a* thereby automatically converting cap 20*a* into a safety cap which immediately will take effect upon positioning of cap 20*a* on the threaded container 28 and initiation of rotation in the clockwise direction. Thereafter, any attempts to move in the counterclockwise direction will cause projections 64*a* to engage with cam surfaces 46*a* and tighten band 24*a* around the neck of the container thereby locking the cap in position.

Figure 11:
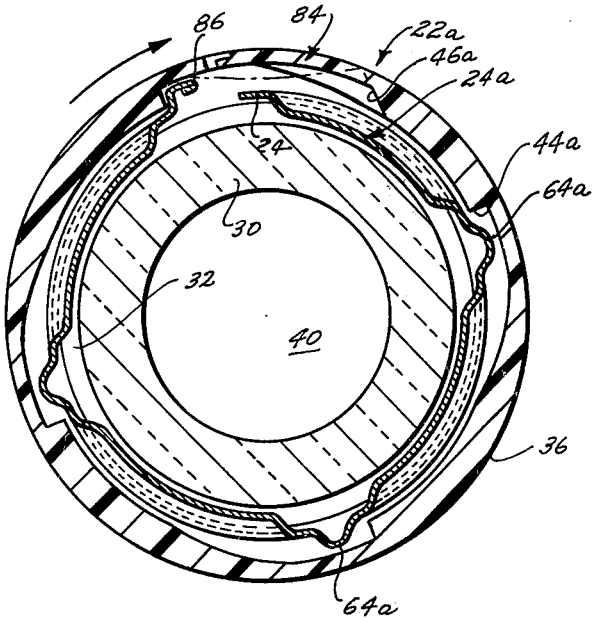
FIG. 11 is a top sectional view of the further embodiment showing the cap in the normal relaxed position and when it is being freely rotated and fastened to the container.
Figure 12:
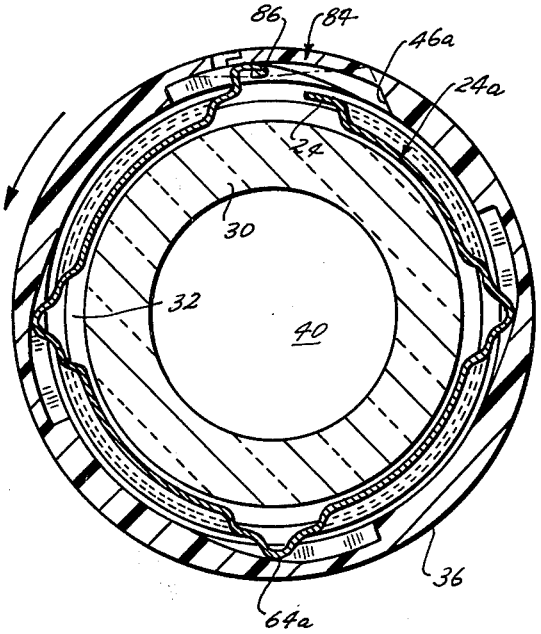
FIG. 12 is a sectional top view of the further embodiment showing the locking structure being activated when an attempt is made to remove the cap without releasing the locking structure.

The sequence of operations can be depicted in FIGS. 11–14. In FIG. 11 the cap is initially placed on the container neck and as depicted by the arrow is rotated in a clockwise direction. Band 24*a* will have its projection 64*a* come into contact with shoulders 44*a* thereby causing band 24*a* to rotate with cover 22*a* until the cap is in the fully fastened position. Should any attempt be made during the fastening operation to rotate cap 20*a* in a counterclockwise direction an effect will occur as depicted in FIG. 12. Projection 64*a* will come in contact with cam surfaces 46*a* tending to contract band 24*a* about the neck of the bottle. Continued attempts to rotate in the clockwise direction will tighten the band constriction about the container and prohibit further movement of the cap in the direction of unfastening with respect to the container. The operation of cap 20*a* is virtually the same as the operation of the previously discussed embodiment in respect to operation of the safety feature of the cap as depicted in FIGS. 11 and 12.

Figure 13:
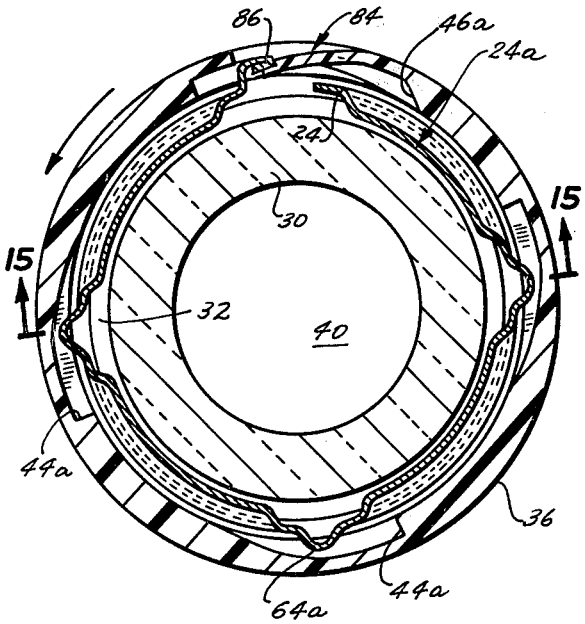
FIG. 13 is a top sectional view of the further embodiment showing the locking structure having been released permitting free rotation of the cap to the unfastened condition.
Figure 14:
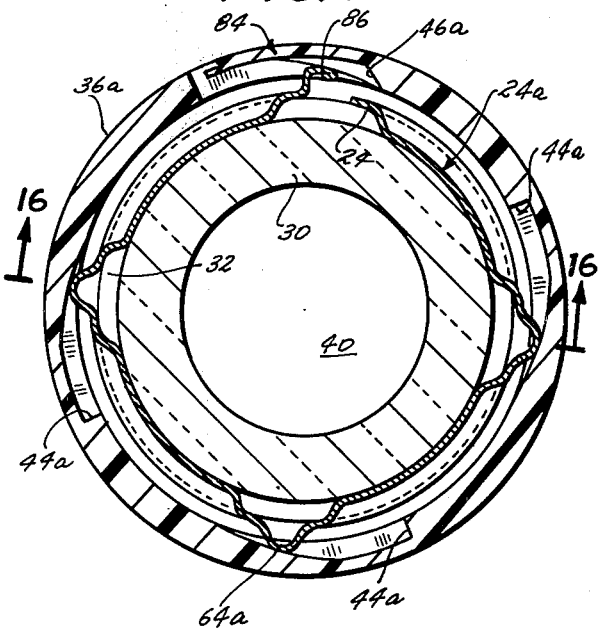
FIG. 14 is a top sectional view thereof showing the cap in the fully locked condition whereupon it cannot be shifted toward the unfastened condition with respect to the container.
Figure 15:
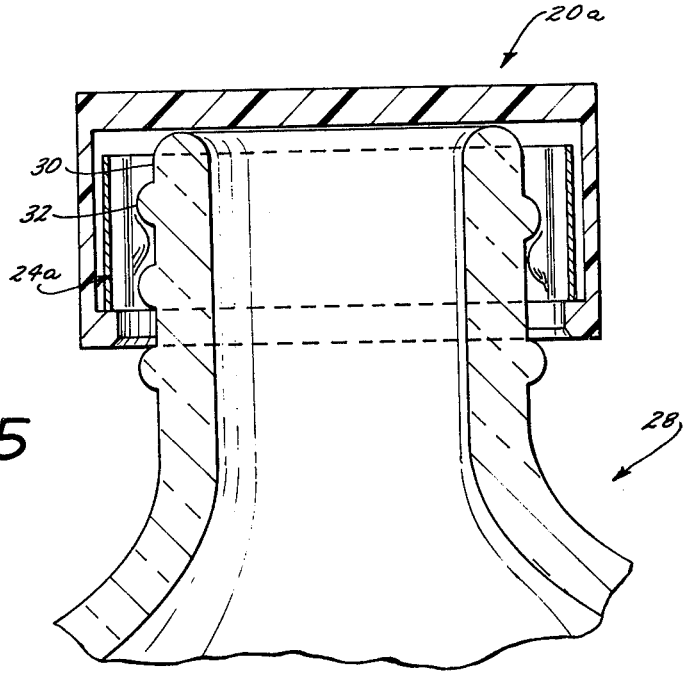
FIG. 15 is a sectional elevational view thereof taken through the plane of line 15—15 of FIG. 13.
Figure 16:
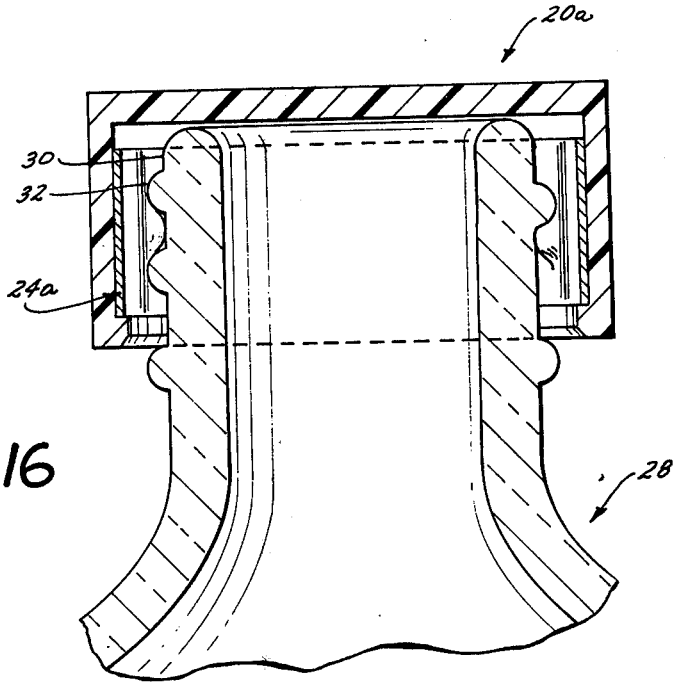
FIG. 16 is a fragmentary sectional elevation view thereof taken along the plane of line 16—16 of FIG. 14.

The release operation of the embodiment of cap 20*a* is somewhat different although the actual resultant effect on the band 24*a* is the same. This structural arrangement is depicted in FIG. 13. Cantilever tab 84 is depressed inward until it is in position to engage with the free L-shaped leading edge 86 of band 24. This overlapping interengagement causes band 24*a* to be retained in position and prevents it from advancing onto cam surfaces 46*a* so as to be contracted about the container neck. Instead it is rotated along with cover 22*a* as the cover is rotated in the counterclockwise direction due to the direction of cantilever tab 24 against L-shaped receiving edge 86 of the band 24*a*.

Thereafter, clockwise rotation of the cap 20*a* will free tab 84 from interengagement with L-shaped leading edge 86 and the resilient nature of the cantilever tab will permit it to return to its initial configuration in substantial continuous alignment with skirt wall 36. The cap can then be continuously rotated clockwise until it is fastened completely on the container again. However, any attempt to rotate the cap in a co counterclockwise direction will cause projection 64*a* to follow cam surfaces 46*a* and constrict band 24*a* around the neck of the bottle thereby locking the cap in position. In conclusion, operation of the embodiment of FIGS. 9–16 is quite similar to the operation of the initially discussed embodiment. There are some changes in structure which have been discussed above including specifically the elimination of the third component, a control ring and, the elimination of a lock-out feature on the structure to permit the cap to operate as a standard cap for a container independent of a safety lock feature. It should be noted that the band 24*a* is retained in position within cover 22*a* by means of an appropriate ledge or undercut 48*a* in a similar fashion as the components are retained within cover 22*a* in regard to the initially discussed embodiment. The materials for the various component parts are the same as the materials employed for the component parts of the initially discussed embodiment. This is also true for other structural features of the similar components parts.

In connection with both of the depicted embodiments when the cap is stopped intermediate a full twist, the user must turn the cap slightly clockwise for permitting it to be released. It should also be stated that in regard to both embodiments depicted and described, basic capping equipment well known in the trade can be utilized to apply the cap to the neck of the container or bottle.

It should also be noted that in the embodiment of FIG. 1, the three piece cap, a full bearing friction surface is provided whereas in the embodiment of FIG. 9, the two piece cap a point bearing arrangement is provided.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A safety cap for a container comprising; an outer cover having an end wall and a peripheral skirt depending therefrom, a band mounted in the cover, means in the band for rotatably fastening and unfastening the band and cover on a container, lock means on the band and cover to permit rotating of the band and cover onto the container into the fastened position and to prevent rotating of the band and cover into the unfastened position, and release means on the band and cover adapted to be shifted between an inactive position whereupon it does not affect the operation of the lock means and an active position whereupon it deactivates the lock means and permits the band and cover to rotate into the unfastened position.

2. The invention in accordance with claim 1 wherein a plurality of spaced inclinded cam surfaces are positioned on the inner surface of the peripheral skirt of the cover and a plurality of inwardly extending shoulders on the inner peripheral surface of the skirt and each shoulder being adjacent to and spaced from a corresponding cam surface, the band being circular in configuration and interrupted at a point on its circumference and a plurality of projections extending outwardly from the circular band with each projection aligned with a corresponding shoulder and cam surface on the skirt of the cover, the projections cooperating with the cam surfaces and the shoulders so that when the cap is rotated into the fastened position, the lock means will not be activated and when the cap is rotated toward the unfastened condition, the lock means will be activated.

3. The invention in accordance with claim 2 wherein when the cap is rotated toward the unfastened position the projections on the band will follow the corresponding cam surfaces causing the band to be compressed and tightly engage the container thereby preventing further movement in that direction and when the cap is rotated toward the fastened position the projections will engage with the corresponding shoulders on the cover so that the band and cover rotate together in completing movement of the cap into the fastened position.

4. The invention in accordance with claim 1 wherein the band is circular in configuration and has threads formed on its outer surface positioned to permit interengagement with the threaded upper neck portion of a container to facilitate shifting of the cap between the fastened and unfastened positions.

5. The invention in accordance with claim 1 wherein the band is circular in configuration and has a coating on its inner surface to provide traction on the inner surface for the band when brought into engagement with the upper portion of a container and thereby to facilitate operation of proper movement of the capped components for activation of the lock means and the release means.

6. The invention in accordance with claim 5 wherein the coating on the inner surface of the band is a rubber-like material.

7. The invention in accordance with claim 2 wherein the release means includes a control ring mounted in the cover and having a control tab extending through an opening in the skirt of the cover, the control ring being resilient to permit the control tab to be pushed inward through the opening in the cover and into engagement with the band and the cover so as to prevent the locking means from operating and permitting the band and cap to freely rotate together in both the fastening and unfastening directions.

8. The invention in accordance with claim 7 wherein the surfaces forming the opening in the skirt of the cover form two positions for the tab of the controlling whereby when the tab is located in the first position it normally will extend through the opening in the skirt unless depressed to interengage with the band and deactivate the lock means and to be shifted to a second position where it will be retained by keeper surface on the tab and the skirt in a position where it will be in engagement with the band to retain the lock means in the inactive position without manual operation of the control ring and thereby permit the cap to be freely shifted between the fastened and unfastened positions.

9. The invention in accordance with claim 8 wherein the circular band is interrupted about its circumference so as to form a pair of spaced vertical edges, the tab having an inwardly extending shoulder with a slot therein positioned so that when the tab is depressed through the opening into alignment with the band, one of the edges of the band will be captured by the slot and held in position when the cap is initiated toward the unfastened position so as to prevent further movement of the band with respect to the cam surfaces and consequent tightening of the band and activation of the locking means, and the tab will be retained in position with the tab in the slot until the cap is again rotated toward the fastened position whereupon the tip will be automatically released and the release means will be deactivated.

10. The invention in accordance with claim 9 wherein the opening in the skirt of the cover is substantially rectangular in configuration and is open at the bottom edge of the skirt of the cover and has a downward extending tooth from the upper edge thereof intermediate the ends to separate the two positions for the control tab with one position being the manual location of a control tab for inactivation of the locked means and the other being the automatic position for the control tab for inactivation of the lock means.

11. The invention in accordance with claim 10 wherein the means to retain the circular band and the control ring in the cover is at least one inwardly projecting rib portion extending from the bottom peripheral edge of the skirt to receive the retainer ring and band thereon.

12. The invention in accordance with claim 1 wherein the release means is a cantilevered portion of the skirt normally in alignment with the remainder of the skirt and adapted to be depressed inwardly so that its edge engages with the band and prevents the lock means from being activated while permitting the band and cap to freely rotate between the fastened and unfastened positions.

13. The invention in accordance with claim 12 wherein the cantilevered tab portion is integrally molded into one cam surface of the skirt of the cap.

14. The invention in accordance with claim 12 wherein the band is circular in configuration and is interrupted so as to form two spaced vertical edges, one of the edges being L-shaped in configuration to facilitate its engagement with the edge of the tab when the tab is depressed inwardly from the remainder of the skirt thereby preventing the lock means from becoming activated and capturing the tab when the cap is rotated toward the unfastened position and automatically releasing the tab when the cap is again rotated toward the fastened position so as to deactivate the release means.

15. The invention in accordance with claim 12 wherein when the tab is released it will return to its initial position in alignment with the remainder of the skirt portion of the cover.

16. The invention in accordance with claim 1 wherein the release means will be automatically retained in the active position while the cap is being rotated toward the unfastened position and will automatically shift to the deactive position when the cap is again started to rotated toward the fastened position.

17. A Safety cap for a container comprising; an outer cover having an end wall and a peripheral skirt depending therefrom, a band mounted in the cover, means in the band for rotatably fastening and unfastening the band and cover on a container, lock means to permit rotating of the band and cover onto the container into the fastened position and to prevent rotating of the band and cover into the unfastened position, and release means adapted to be shifted between an inactive position whereupon it does not affect the operation of the lock means and an active position whereupon it deactivates the lock means and permits the band and cover to rotate in the unfastened position.

18. The invention in accordance with claim 17 wherein means are provided for supplying full bearing surface of the band on the neck of the container.

19. The invention in accordance with claim 17 wherein means are provided for supplying a selected number of restricted bearing points of the band on the neck of the container.

20. The invention in accordance with claim 17 wherein means are provided for having the band and cover move together in removing the cap from the neck of the container.

21. The invention in accordance with claim 17 wherein means are provided for permitting the band and cover to slip relative to one another in order to get relative rotation at the start of unscrewing.

22. The invention in accordance with claim 21 wherein a friction surface is provided on the band to create a drag between the band and the neck of the container whereby relative rotation between the band and cover is obtained when the cap is unscrewed whereupon the lock means is activated to cause binding the band on the neck of the container.

23. The invention in accordance with claim 20, wherein means are provided for shifting the release means to a third position after the release means has been shifted to its active position to permit the band and cover to move together while fastening and unfastening the band and cover on the container while maintaining the lock means deactivated.

* * * * *